US009408488B2

(12) United States Patent
Bizzarri

(10) Patent No.: US 9,408,488 B2
(45) Date of Patent: Aug. 9, 2016

(54) MULTI-POSITIONAL DRINK COASTER

(71) Applicant: Dominick Bizzarri, Hamilton Square, NJ (US)

(72) Inventor: Dominick Bizzarri, Hamilton Square, NJ (US)

( * ) Notice: Subject to any disclaimer, the term of this patent is extended or adjusted under 35 U.S.C. 154(b) by 0 days.

(21) Appl. No.: 14/857,157

(22) Filed: Sep. 17, 2015

(65) Prior Publication Data

US 2016/0081506 A1 Mar. 24, 2016

Related U.S. Application Data

(60) Provisional application No. 62/052,827, filed on Sep. 19, 2014.

(51) Int. Cl.
*A47G 23/02* (2006.01)
*A47G 23/03* (2006.01)

(52) U.S. Cl.
CPC ..... *A47G 23/03* (2013.01)

(58) Field of Classification Search
USPC ..... 248/346.11, 310, 146
See application file for complete search history.

(56) References Cited

U.S. PATENT DOCUMENTS

| | | | | |
|---|---|---|---|---|
| 2,731,056 | A | 1/1956 | Anson | |
| 3,028,702 | A | 4/1962 | St. Cyr | |
| 3,598,270 | A * | 8/1971 | Adomaitis | B65D 1/0284 215/375 |
| 4,152,863 | A | 5/1979 | Kubiatowicz | |
| 4,340,146 | A * | 7/1982 | Stratton | A47G 23/032 215/394 |
| 4,726,553 | A | 2/1988 | Wischusen, III | |
| 4,941,635 | A | 7/1990 | Lan | |
| 7,335,085 | B2 | 2/2008 | Lyman | |
| 8,162,170 | B1 * | 4/2012 | Massad | B65D 25/24 220/592.17 |
| 8,376,304 | B2 | 2/2013 | Almada | |
| D679,553 | S | 4/2013 | Williams et al. | |
| 2006/0075770 | A1 * | 4/2006 | Lefkowitz | A47G 23/0313 62/457.4 |
| 2008/0029426 | A1 * | 2/2008 | Anderson | B65D 1/36 206/567 |
| 2011/0114812 | A1 * | 5/2011 | an Goolen | A47G 23/03 248/346.03 |
| 2015/0114963 | A1 * | 4/2015 | Billett | B65D 51/249 220/212 |

* cited by examiner

*Primary Examiner* — Steven Marsh
(74) *Attorney, Agent, or Firm* — Panitch Schwarze Belisario & Nadel LLP

(57) ABSTRACT

A multi-positional drink coaster includes a generally planar outer rim defining a periphery of the drink coaster. A base wall skirts downwardly from the outer rim to a base of the drink coaster. The base is configured to rest atop an underlying surface. A flexible central support depends laterally inwardly from the outer rim and includes opposed upper and lower surfaces. The flexible central support area is manually deflectable between a stationary collapsed position and a stationary expanded position. In the collapsed position, the upper surface defines a generally horizontal plane for supporting an object thereon and the lower surface is generally convex. In the expanded position, the flexible central support area forms an ornamental dome structure with both the upper surface being generally convex and the lower surface being generally concave.

16 Claims, 16 Drawing Sheets

MULTI-POSITIONAL DRINK COASTER

CROSS-REFERENCE TO RELATED APPLICATIONS

This application claims priority to U.S. Provisional Patent Application No. 62/052,827, filed on Sep. 19, 2014, entitled "Multi-Positional Drink Coaster," the entire contents of which are incorporated by reference herein.

BACKGROUND OF THE INVENTION

The present invention relates generally to drink coasters and, more specifically, to a coaster that can be manipulated into various positions. It is well known in the art that drinking or eating vessels (herein collectively referred to as vessels), such as cups, mugs, glasses, and bottles, can cause damage to surfaces of furniture due to the heat from the vessels' contents or the condensation that may be produced by the vessels' chilled contents. Accordingly, the drink coaster was invented decades ago to guard surfaces from the damaging effects of these vessels and their contents. The art has continued to develop over recent years with introductions such as the Non-stick Drink Coaster (U.S. Pat. No. 4,858,873), Compact Disc Drink Coaster (U.S. Pat. No. 5,775,669), Sandal Drink Coasters (U.S. application Ser. No. 13/669,443), Electronic Drink Coaster (U.S. Pat. No. 7,353,136), and Attachable Beverage Coaster (U.S. Pat. No. 4,759,525).

These developments signify a shift from focusing purely on the functionality of a drink coaster to a more decorative nature. In another section of the art, there is a focus on dual functions such as the Drink Coaster and Air Freshener (U.S. Pat. No. 6,695,272). Clearly, there is a need for drink coasters that serve other functions in conjunction with protecting furniture surfaces from damage. Thus, it is one object of the present invention to provide a drink coaster with more than two uses. The preferred embodiment accomplishes this by having a first configuration, a second configuration, and a constant decorative nature.

The preferred first configuration, for example, may function solely to protect furniture from damage caused by a vessel. A second configuration may also function in the form of a cute novelty item or decorative trinket. Regardless of the configuration, the preferred drink coaster always provides viewers with a decorative nature which can be appreciated when in use or when stagnant. It is a further object of the present invention to provide a decorative coaster for use with vessels containing either hot or cold liquids that will prevent damage to furniture supporting the same.

These and other objects of the present invention will become more apparent upon a reading of the complete description thereof in combination with the following drawings.

BRIEF SUMMARY OF THE INVENTION

Briefly stated, one aspect of the present invention is directed to a multi-positional drink coaster. The drink coaster includes a generally planar outer rim defining a periphery of the drink coaster. A base wall skirts downwardly from the outer rim to a base of the drink coaster. The base is configured to rest atop an underlying surface. A flexible central support depends laterally inwardly from the outer rim and includes opposed upper and lower surfaces. The flexible central support area is manually deflectable between a stationary collapsed position and a stationary expanded position. In the collapsed position, the upper surface defines a generally horizontal plane for supporting an object thereon and the lower surface is generally convex. In the expanded position, the flexible central support area forms an ornamental dome structure with both the upper surface being generally convex and the lower surface being generally concave.

Another aspect of the present invention is also directed to a multi-positional drink coaster. The drink coaster includes a generally planar outer rim defining a periphery of a top surface of the coaster. A base wall skirts downwardly from the outer rim to a base of the drink coaster. The base is configured to rest atop an underlying surface. A flexible central support area is located inward of the outer rim, the central support area including at least a first section depending inwardly from the outer rim, a second section depending inwardly from the first section and a plurality of support members projecting upwardly from the first and second sections. The central support area is manually deflectable between a collapsed position and an expanded position. In the collapsed position, the first section depends from the outer rim at a concave angle, the second section depends from the first section at a concave angle and the support members project upwardly to the outer rim, defining a generally horizontal plane for supporting an object thereon. In the expanded position, the first section depends from the outer rim at a convex angle and the second section depends from the first section at a convex angle, such that central support area and the support members form an ornamental dome structure.

BRIEF DESCRIPTION OF THE DRAWINGS

The foregoing summary, as well as the following detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
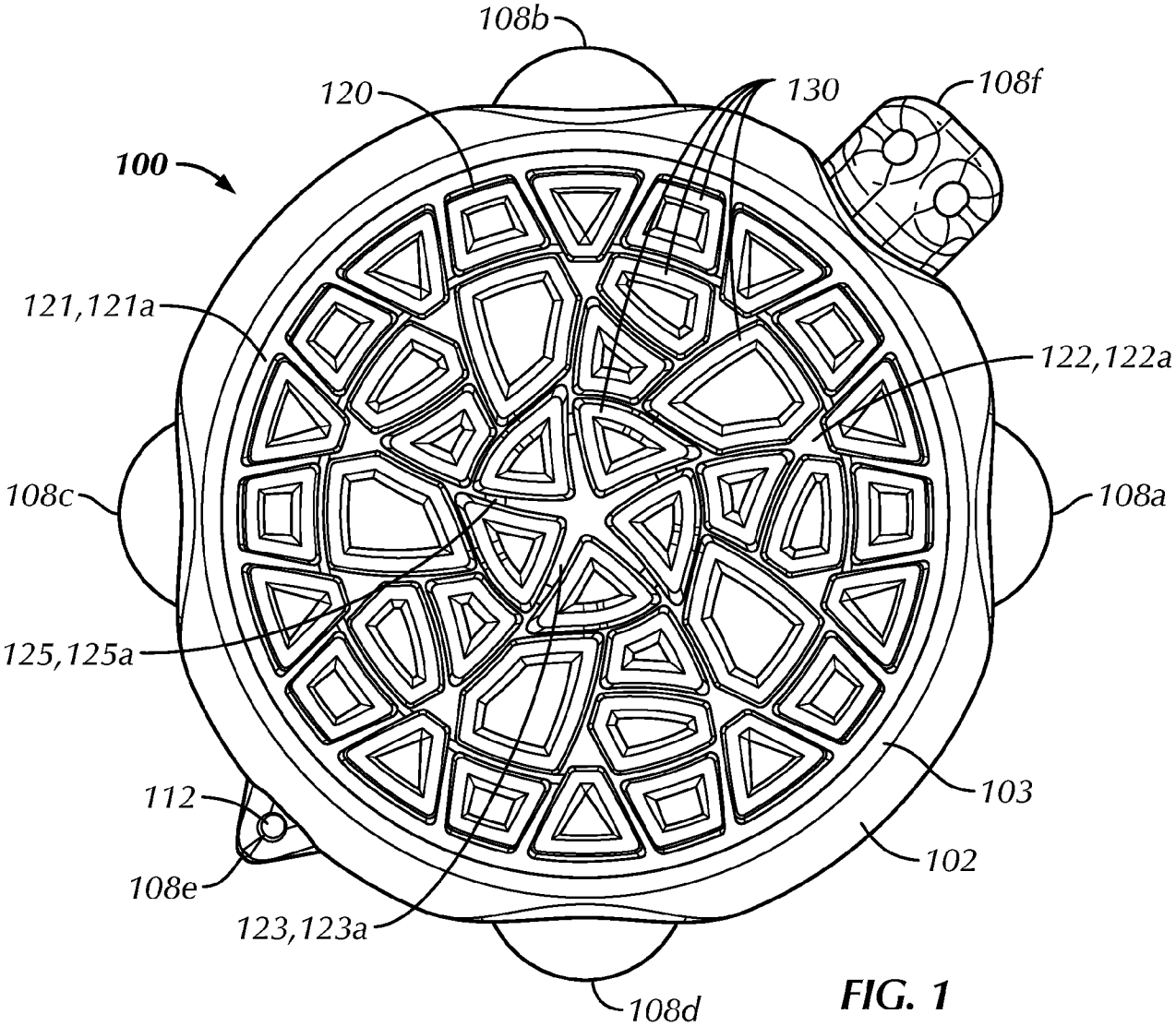
FIG. 1 is a top plan view of a drink coaster in a collapsed position in accordance with a preferred embodiment of the present invention.
Figure 2:
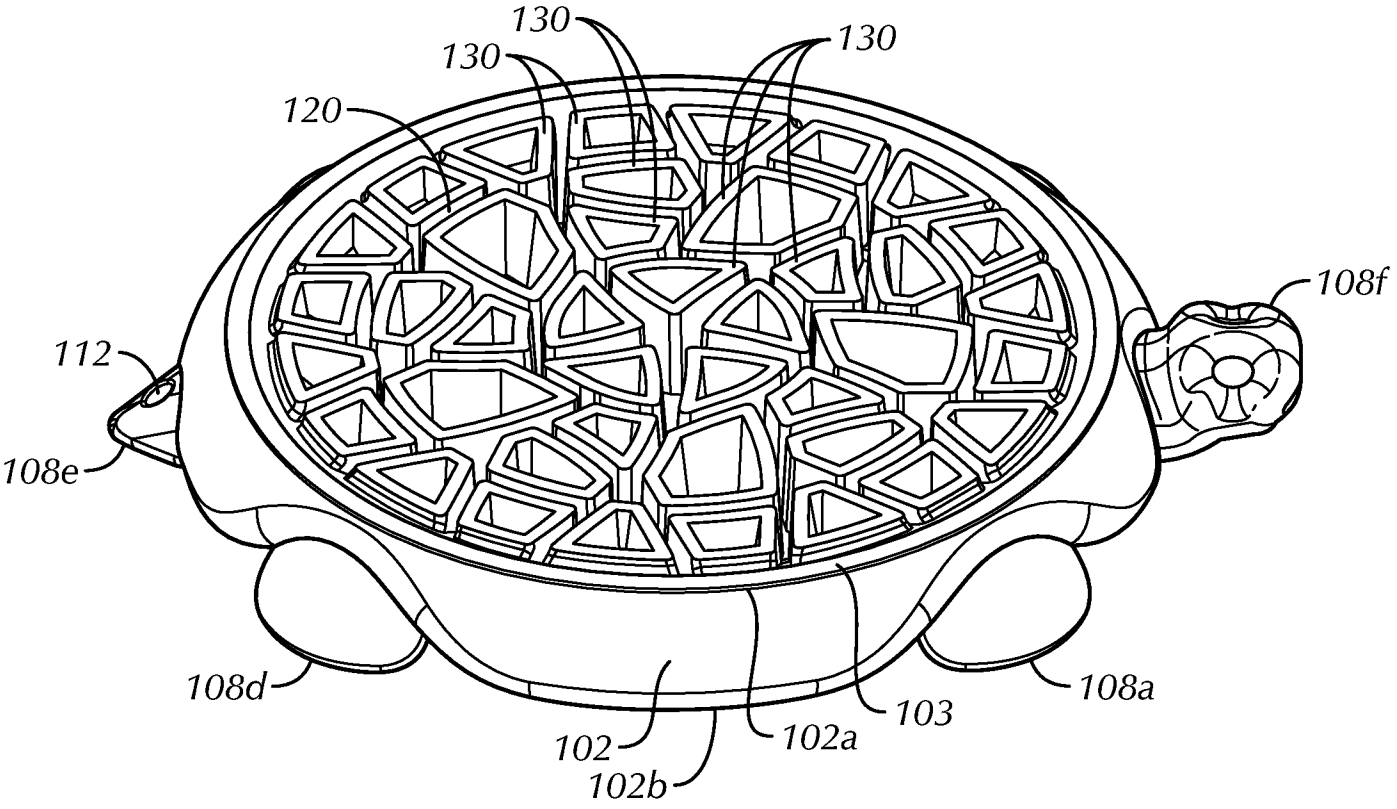
FIG. 2 is a right side and top perspective view of the drink coaster of FIG. 1 in the collapsed position.
Figure 3:
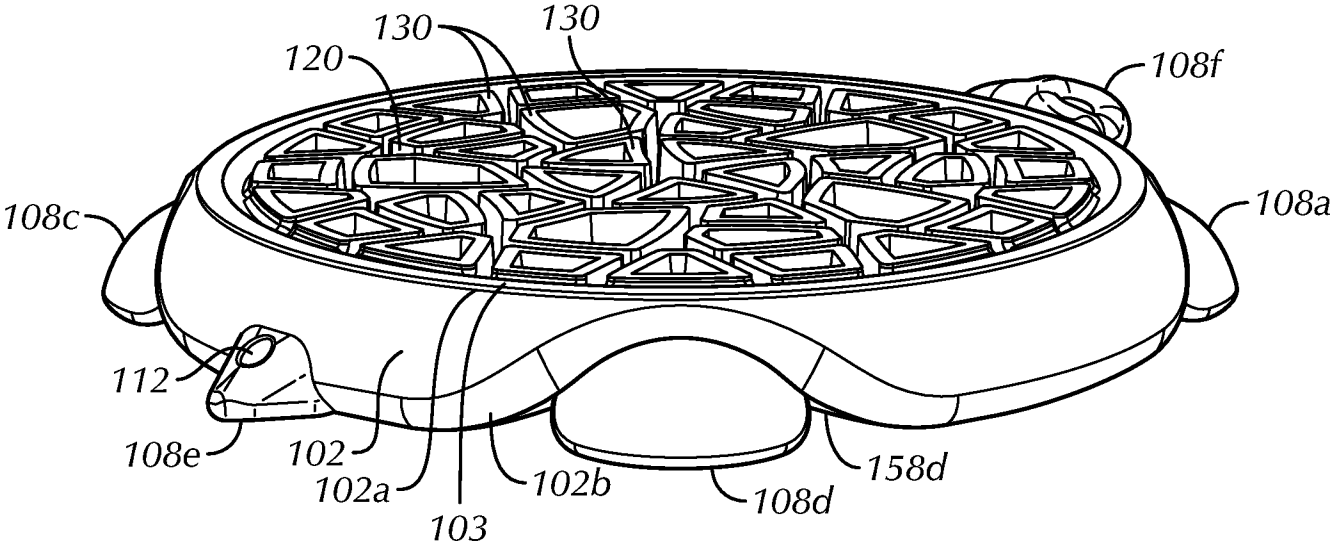
FIG. 3 is a rear right perspective view of the drink coaster of FIG. 1 in the collapsed position.
Figure 4:
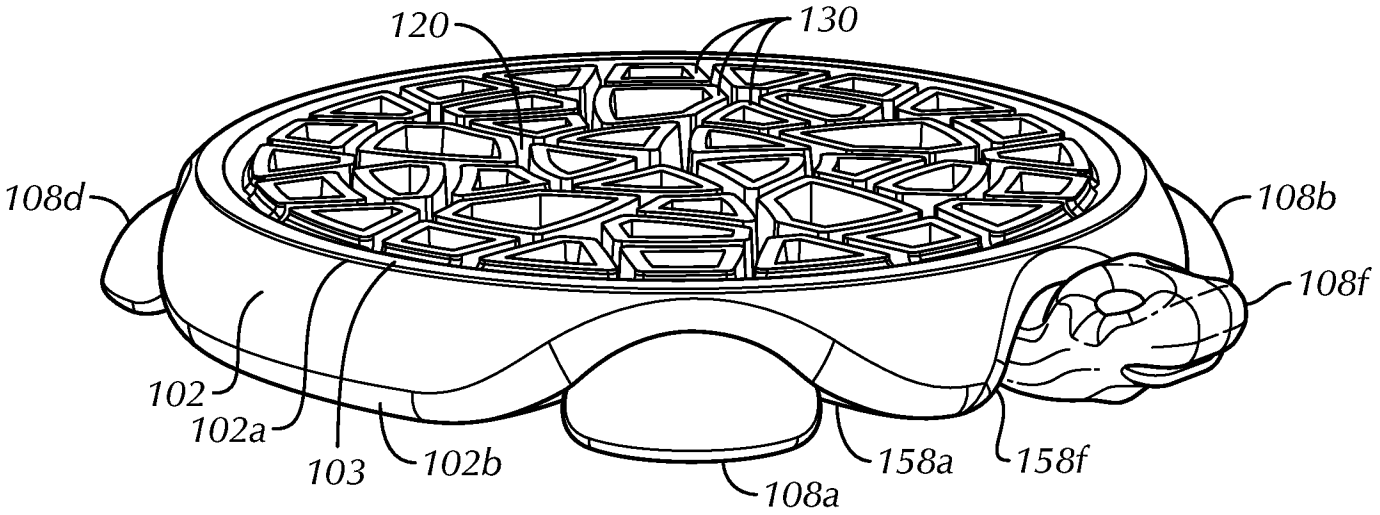
FIG. 4 is a front right perspective view of the drink coaster of FIG. 1 in the collapsed position.
Figure 5:
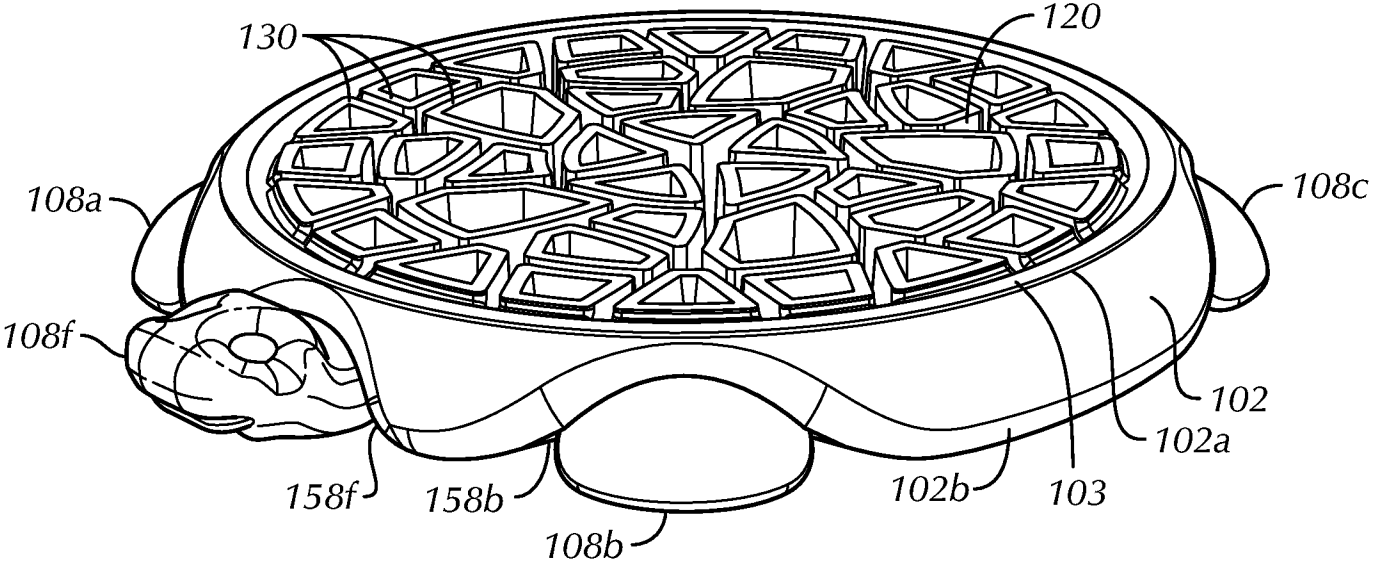
FIG. 5 is a front left perspective view of the drink coaster of FIG. 1 in the collapsed position.
Figure 6:
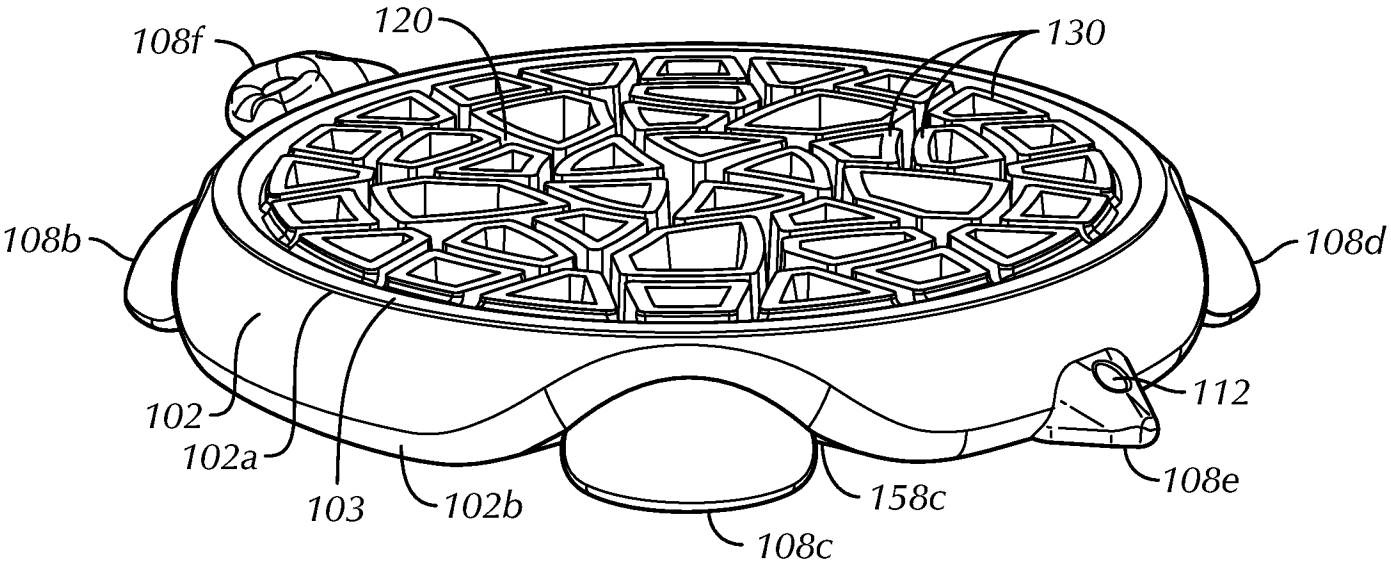
FIG. 6 is a rear left perspective view of the drink coaster of FIG. 1 in the collapsed position.

Certain terminology is used in the following description for convenience only and is not limiting. Unless specifically set forth herein, the terms "a", "an" and "the" are not limited to one element but instead should be read as meaning "at least one". The words "right," "left," "lower," and "upper" designate directions in the drawings to which reference is made. The words "inwardly" or "distally" and "outwardly" or "proximally" refer to directions toward and away from, respectively, the geometric center or orientation of the drink coaster and related parts thereof. The terminology includes the above-listed words, derivatives thereof and words of similar import.

Referring to the drawings in detail, wherein like numerals indicate like elements throughout, FIGS. 1-17 show a drink coaster, generally designated 100, in accordance with a preferred embodiment of the present invention. The drink coaster can be used to create a barrier between one surface and the base of a vessel. However, the drink coaster may also function as a decorative trinket or cute novelty item when in certain positions described herein. FIGS. 1-8, and 17 show the drink coaster in a first configuration wherein the drink coaster is in a collapsed position. FIGS. 9-16 show the drink coaster in a second configuration wherein the drink coaster is in an expanded position.

The drink coaster 100 is preferably of one piece construction and is fabricated from a polymeric material, such as a silicone material, using injection molding or other similar manufacturing techniques. However, the drink coaster 100 is not limited to being constructed using these materials or techniques and may be constructed of any material and using any technique that is able to produce the general size and shape of the drink coaster 100 that functions in the manner of the drink coaster 100, as is described in greater detail below.

In the preferred embodiment, the drink coaster 100 resembles a Testudine; however, it may resemble any mammal, fish, plant, other members of the animal kingdom or another design, such as a golf ball. In the illustrated embodiment, the drink coaster 100 is generally of a circular shape. However, the drink coaster 100 may take form in any of the various geometric shapes. Further, the drink coaster 100 may resemble anything, such as a planet or mountain or computer or sports paraphernalia or similar, or nothing at all such as a purely geometric shape.

The drink coaster 100 may be situated in either a collapsed position or an expanded position described herein. For clarity, the drink coaster 100 will be initially described with respect to its collapsed position shown in FIGS. 1-8, 17.

As shown, the drink coaster 100 includes a base wall 102 which defines the outer edge of the drink coaster 100. The drink coaster 100 further includes an outer rim 103 which defines the peripheral edge of a top surface 110 of the drink coaster. The outer rim 103 may, for example, be of a generally circular shape, or, alternatively, any other shape. The base wall 102 depends downwardly and outwardly at a generally arcuate angle from the outer rim 103. However, the base wall 102 may extend downwardly from the outer rim 103 at any angle or any orientation, such as perpendicularly, acutely, or obtusely. The base wall 102 includes a top section 102*a* and a bottom section 102*b*. The top section 102*a* abuts the outer rim 103. The bottom section 102*b* demarcates the limit of the base wall 102 and abuts a base 150.

In the illustrated embodiment, at one location exists a head member 108*f* which may, for example, denote the front of the drink coaster 100. The head member 108*f* depicts the head of a Testudine in the illustrated embodiment, but is not so limited and may simply depict, for example, a geometric shape. The head member 108*f* generally protrudes outwardly from the base wall 102. As shown, outer feet 108*a-d* are also located radially around the base wall 102. The outer feet 108*a-d* may be unnecessary to provide additional stabilization for the drink coaster 100, or there may be a need for additional feet (not shown). The outer feet 108*a-d* protrude generally radially outwardly from the base wall 102. At another position radially about the base wall 102 is a hanging member 108*e* which protrudes generally outwardly from the base wall 102. The hanging member 108*e* may provide additional support for the drink coaster 100 or may assist in ease of storage or be used at a store display, but is not so limited. Ease of storage may be achieved by, for example, hanging the drink coaster 100 from a fixture by using a hanging hole 112. The hanging hole 112 is a through hole oriented perpendicularly to the hanging member 108*e*. In the illustrated embodiment, the hanging member 108*e* is located radially opposite from the head member 108*a*, but may be located at any position radially along the base wall 102 with respect to the head member 108*a*. Additionally, the hanging hole 112 is not restricted to a specific orientation or form and may, for example, be oriented parallel to the hanging member 108*e* or at any other angle.

Figure 8:
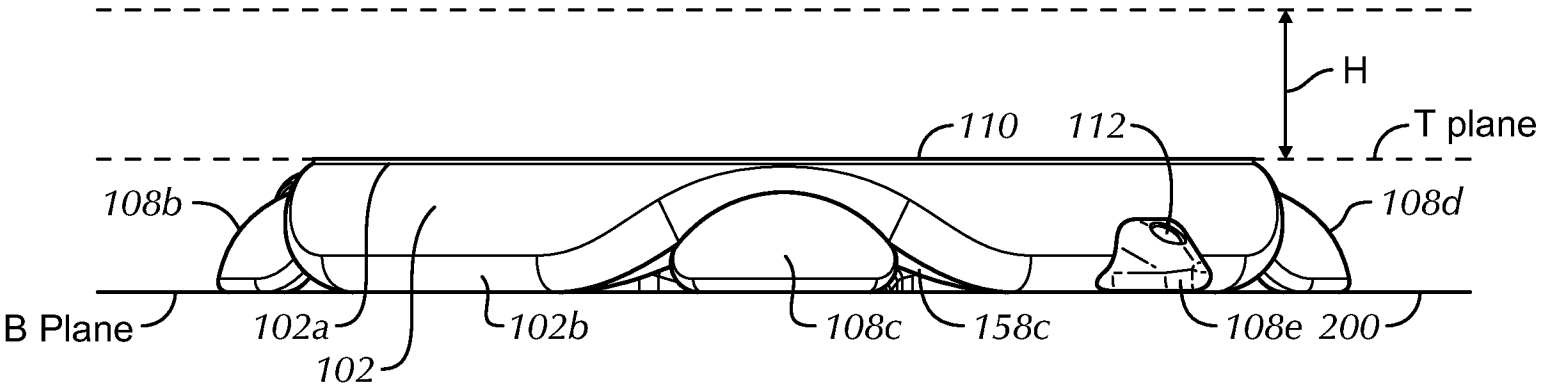
FIG. 8 is a rear left elevational view of the drink coaster of FIG. 1 in the collapsed position.
Figure 9:
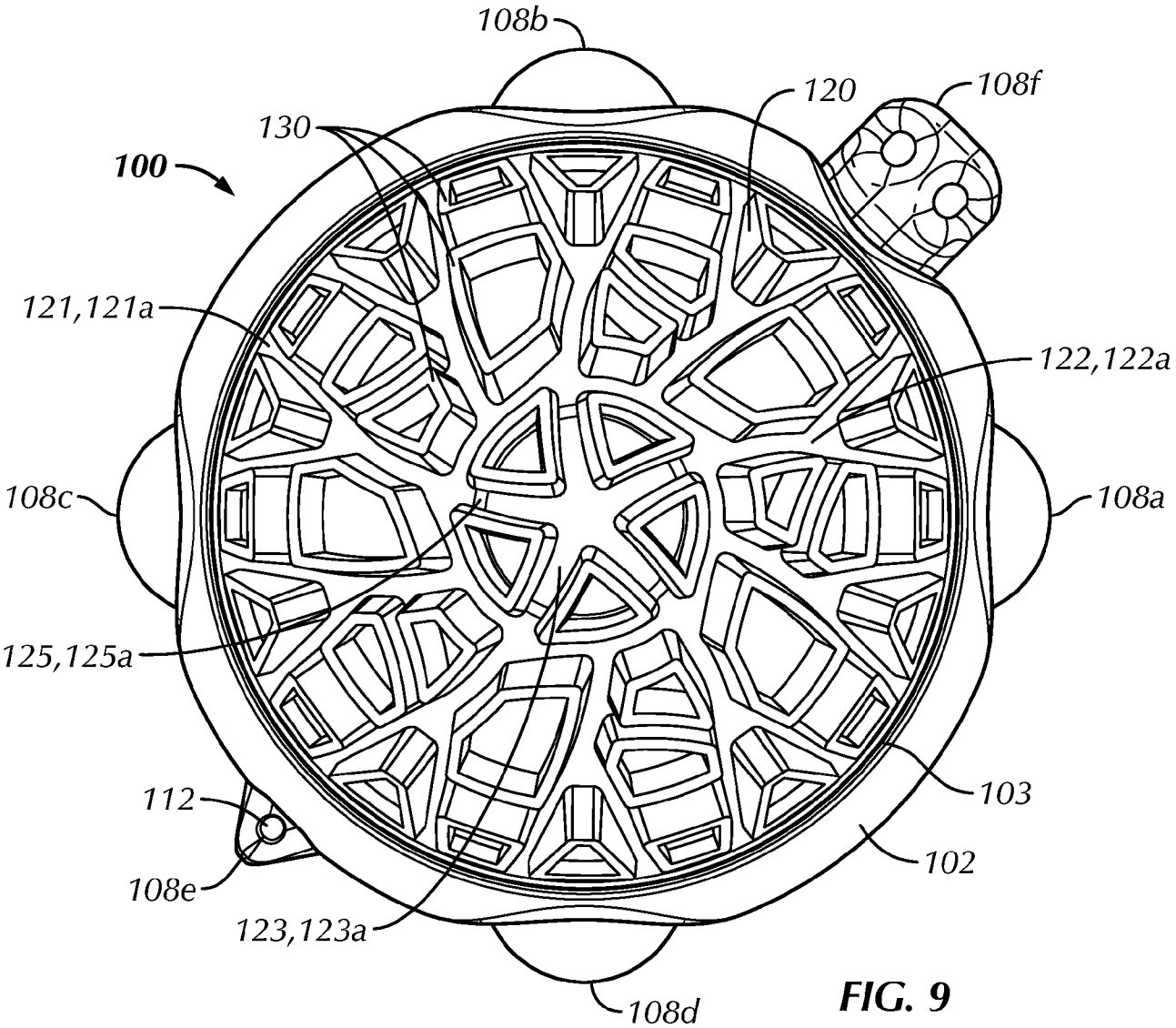
FIG. 9 is a top plan view of the drink coaster of FIG. 1 in an expanded position.
Figure 10:
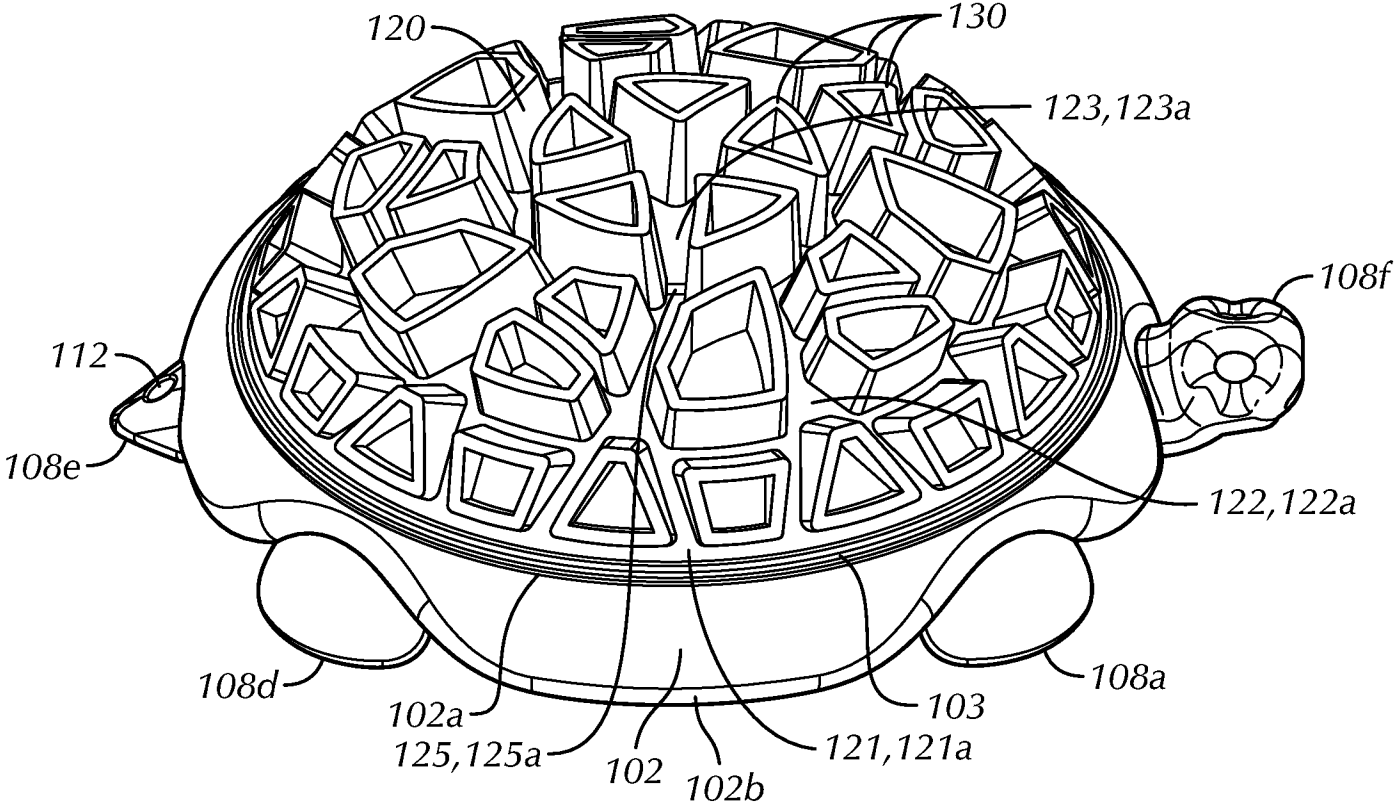
FIG. 10 is a right side and top perspective view of the drink coaster of FIG. 1 in the expanded position.

Referring to FIG. 8, the outer rim 103 is preferably planar with the top surface 110 of the drink coast 100. The top surface 110 generally occupies a plane T. In the collapsed position, the top surface 110 is generally planar and remains generally parallel to an underlying resting surface 200. The resting surface 200 may include a kitchen counter, table, stand, or similar furniture-like object for placing vessels on top of. A plane B exists below and parallel to plane T. The drink coaster 100 contacts the resting surface 200, via the base 150, on plane B. However, the drink coaster 100 could also contact the resting surface 200, via the top surface 110, on plane T.

The exemplary drink coaster 100 further includes a central support area 120 located inward from the outer rim 103. The central support area 120 preferably provides a flat surface for placing items on the drink coaster 100 in the collapsed position. In the illustrated expanded position, the central support area 120 becomes a dome-like structure that may be used as a trinket or novelty item, for example.

Figure 7:
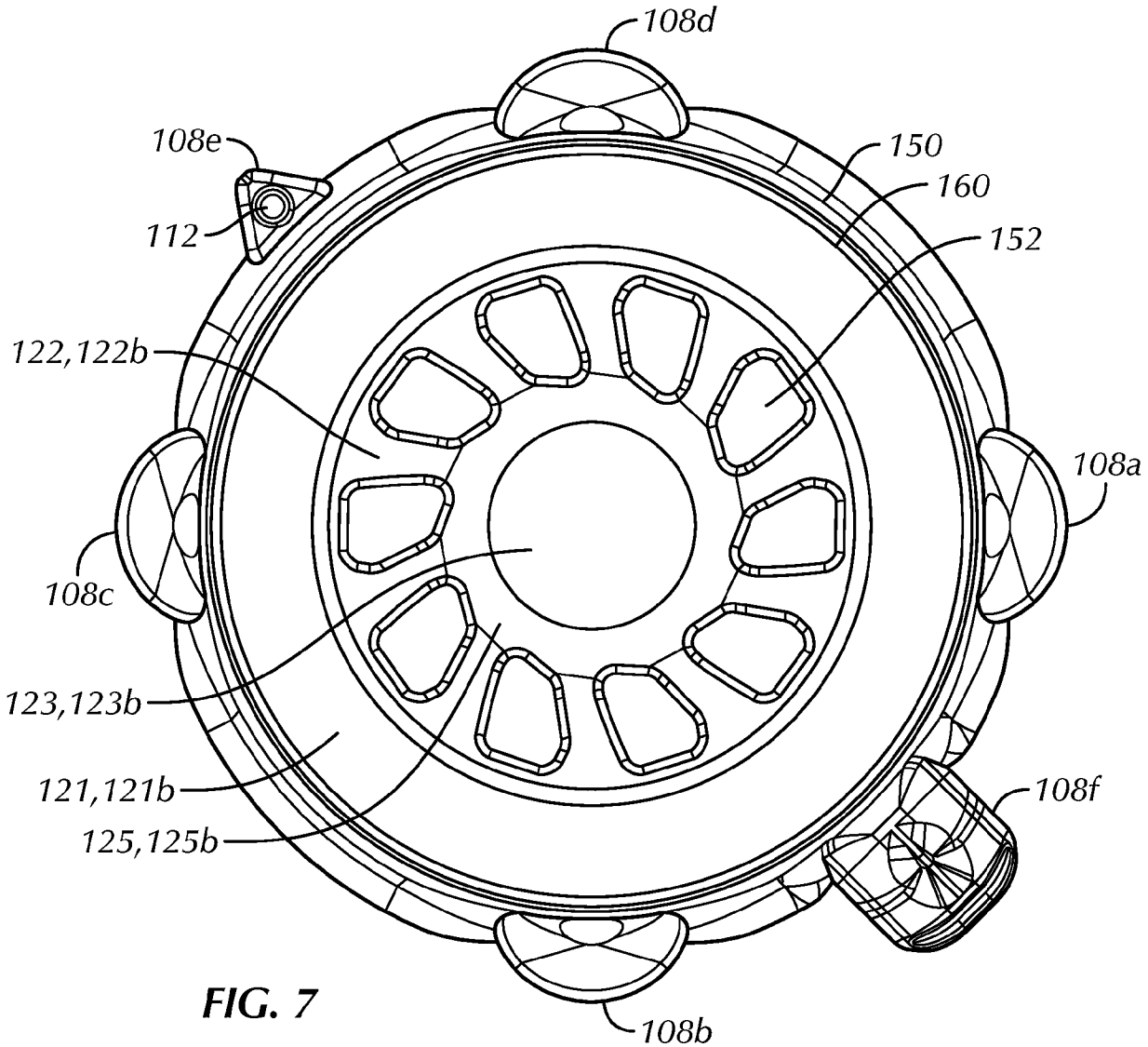
FIG. 7 is a bottom plan view of the drink coaster of FIG. 1 in the collapsed position.
Figure 11:
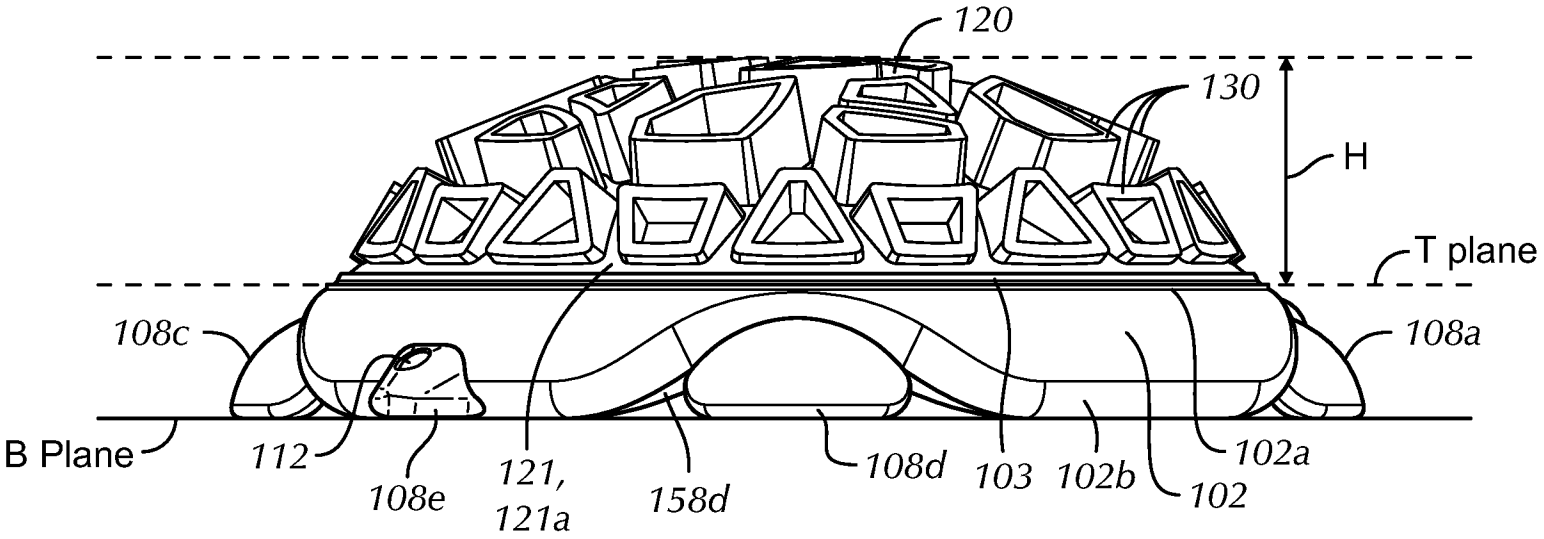
FIG. 11 is a rear right elevational view of the drink coaster of FIG. 1 in the expanded position.
Figure 12:
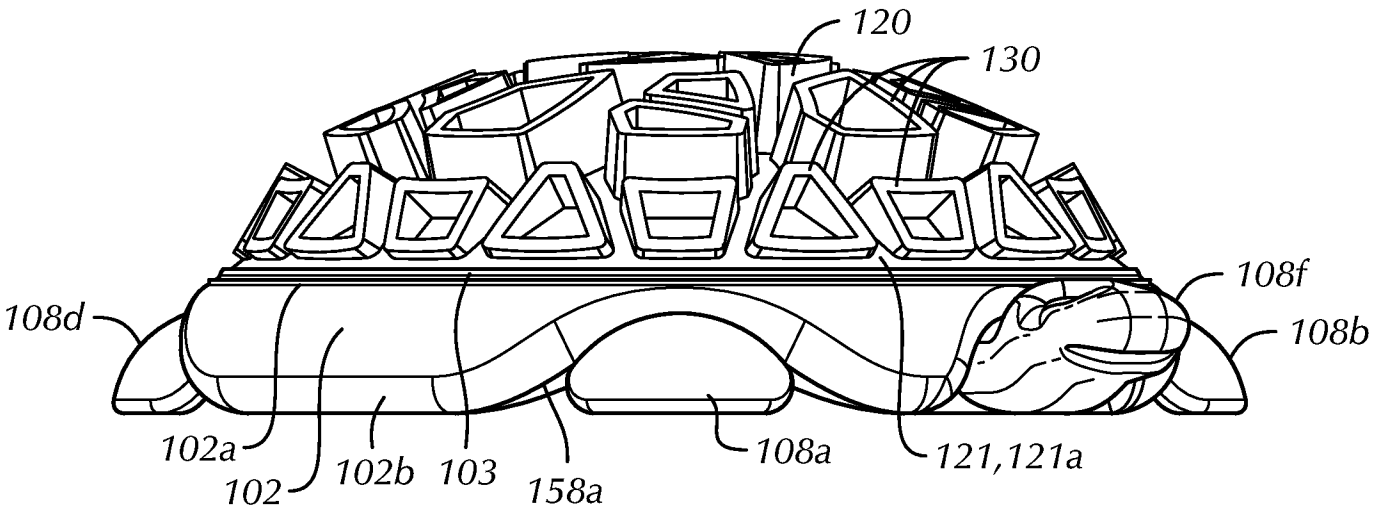
FIG. 12 is a front right elevational view of the drink coaster of FIG. 1 in the expanded position.
Figure 13:
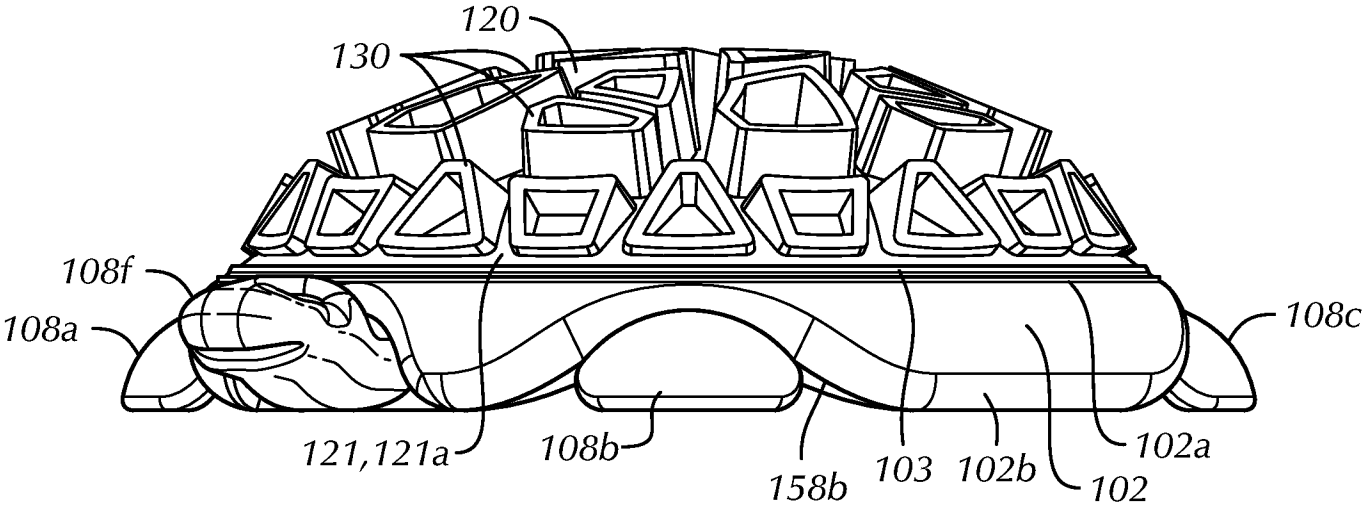
FIG. 13 is a front left elevational view of the drink coaster of FIG. 1 in the expanded position.
Figure 14:
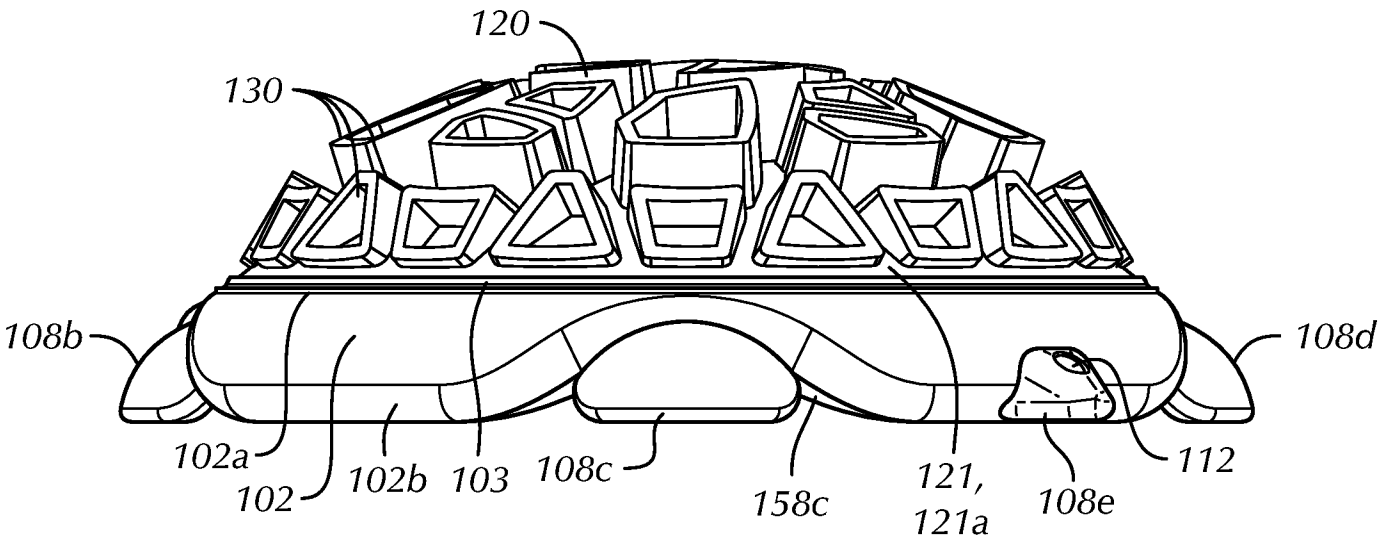
FIG. 14 is a rear left elevational view of the drink coaster of FIG. 1 in the expanded position.
Figure 15:
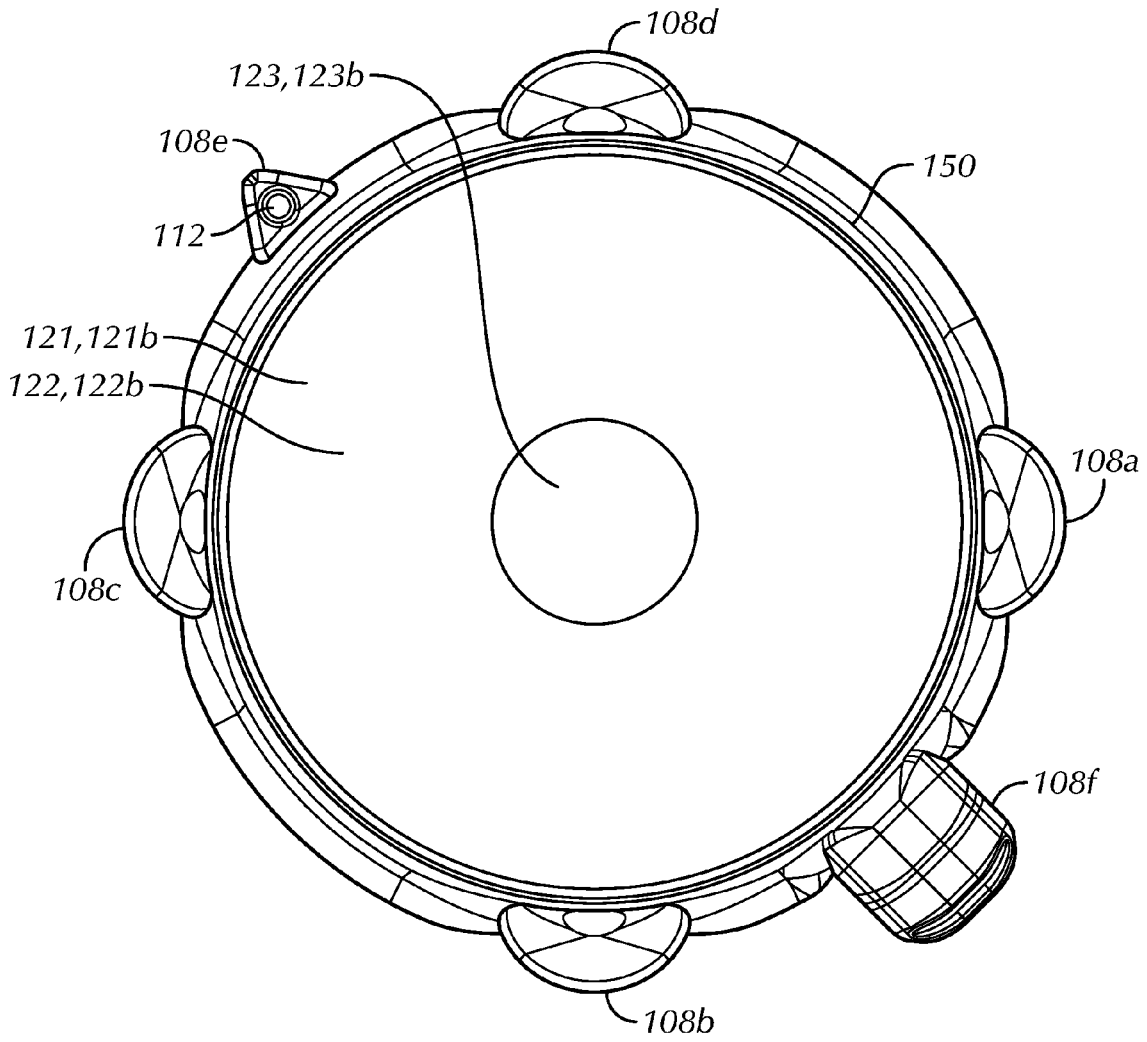
FIG. 15 is a bottom plan view of the drink coaster of FIG. 1 in the expanded position.
Figure 16:
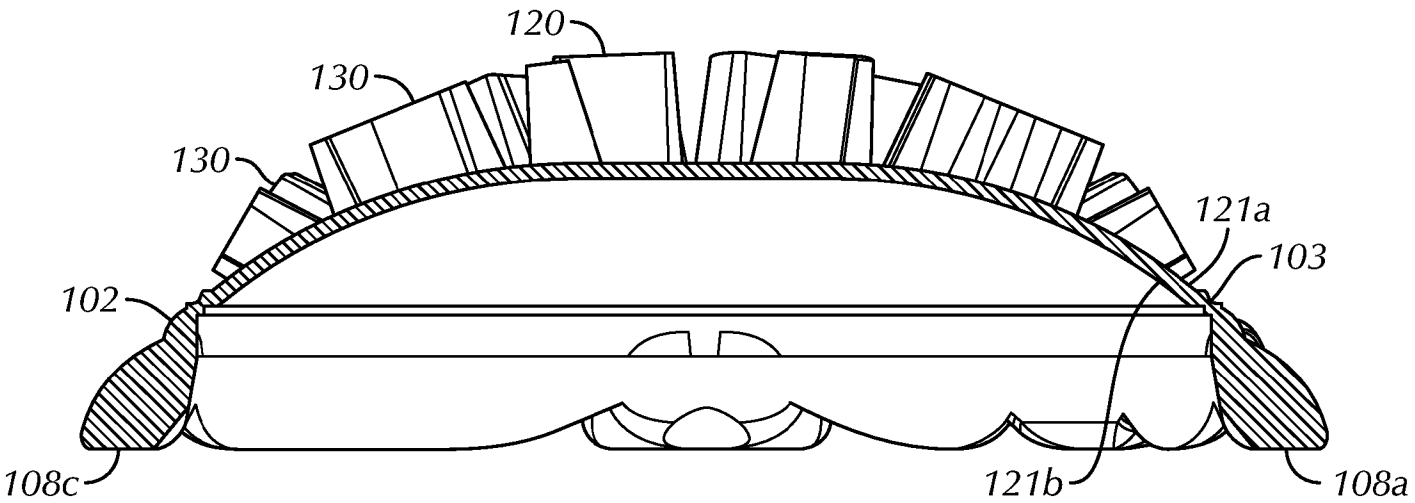
FIG. 16 is a rear right cross-sectional view of the drink coaster of FIG. 1 in the expanded position.
Figure 17:
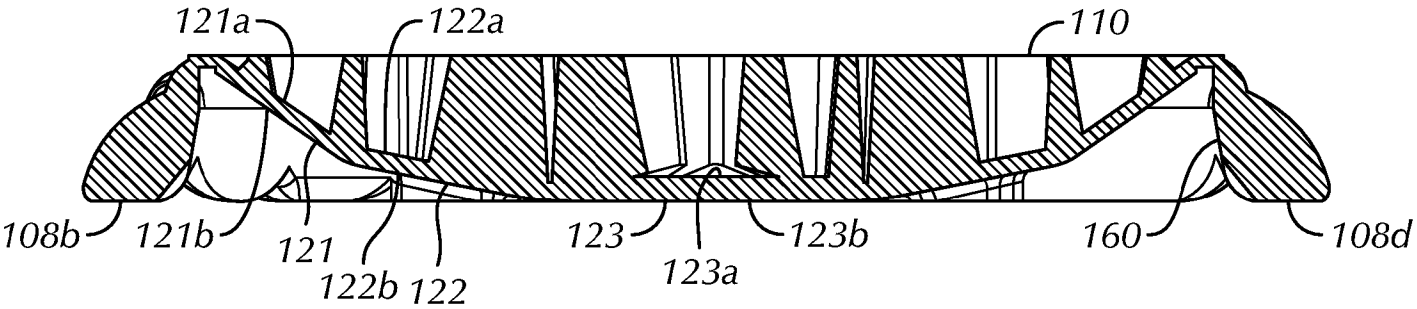
FIG. 17 is a rear right cross-sectional view of the drink coaster of FIG. 1 in the collapsed position.

Referring to FIGS. 1, 7 and 11, the drink coaster 100 also includes a first section 121 and a second section 122. The first section 121 depends radially inwardly from the outer rim 103 at a generally concave angle. When in the collapsed position, a top side 121*a* of the first section 121 forms the concave angle. The first section 121 also includes a bottom side 121*b* which opposes the top side 121*a* of the first section 121. Preferably, the bottom side 121*b* of the first section 121 forms the same concave angle as the top side 121*a* of the first section 121. However, the top side of the first section 121*a* and bottom side of the first section 121*b* may form different angles, for example, if the first section 121 is not of uniform thickness.

In the illustrated embodiment, at a given point, the second section 122 depends from the first section 121 radially inwardly at an angle generally less concave than the concave angle of the first section 121 depending from the outer rim 103. The second section 122 is not so limited and may extend at a concave angle equal to or greater than the concave angle of the first section 121. When in the collapsed position of FIGS. 1-8, 17, a top side 122*a* of the second section 122 forms a concave angle. The second section 122 also includes a bottom side 122*b* which opposes the top side 122*a* of the second section 122. Preferably, the bottom side 122*b* of the second section 122 forms the same concave angle as the top side 122*a* of the second section 122. However, the top side 122*a* of the second section 122 and bottom side 122*b* of the second section 122 may form different angles, for example, if the second section 122 is not of uniform thickness.

Referring to FIGS. 1, 7 and 11, in the illustrated embodiment, the second section 122 extends inwardly at a concave angle to plane B. One embodiment of the drink coaster 100 further includes a support section 125 depending inwardly from the second section 122 at an angle generally parallel to plane B. The support section 125 makes contact with the resting surface 200. The support section 125 may provide additional support for the drink coaster 100 in a location more central than the base 150. When in the collapsed position of FIGS. 1-8, 17, a top side 125*a* of the support section 125 is parallel to plane B. The support section 125 also includes a bottom side 125*b* of the support section 125 which opposes the top side 125*a* of the support section 125. Preferably, the bottom side 125*b* of the support section 125 forms the same angle as the top side 125*a* of the support section 125. However, the top side 125*a* of the support section 125 and bottom side 125*b* of the support section 125 may form different angles, for example, if the support section 125 is not of uniform thickness.

In other embodiments, a support section 125 may not be necessary to provide additional support for the drink coaster 100. Moreover, the support section 125 may be oriented, for example, at any angle not parallel plane B.

In the illustrated embodiment, a third section 123 depends inwardly from the support section 125 at a generally convex angle. The third section 123 is not so limited, however, and may depend from the second section 122. Furthermore, the third section 123 may depend from the support section 125 or second section 122 at any angle, such as, for example, perpendicular to plane T, or at a concave angle. When in the collapsed position of FIGS. 1-8, 17, a top side 123*a* of the third section 123 forms a convex angle relative to plane B. The third section 123 also includes a bottom side 123*b* which opposes the top side 123*a* of the third section 123. Preferably, the bottom side 123*b* of the third section 123 forms the same convex angle as the top side 123*a* of the third section 123. However, the top side 123*a* of the third section 123 and bottom side 123*b* of the third section 123 may form different angles, for example, if the third section 123 is not of uniform thickness.

The first section 121, second section 122, third section 123, and support section 125 are not limited by the term "section" or the depiction in FIGS. 1-17 of a ring-like geometry. Each may alternatively take the form of, for example, a polygon or triangle or any other shape and also may be formed of only one section. The drink coaster 100 may be of any size, shape, material, or other pertinent property, that is competent to deflect between a collapsed position and an expanded position.

In at least one embodiment, the drink coaster 100 includes a plurality of vessel supports 130. Preferably, the vessel supports 130 are oriented radially around and protrude upwardly from the first section 121, second section 122 or third section 123 upwardly to the generally flat plane T at an angle generally perpendicular to plane T. This results in varying heights of the vessel supports 130 due to the arcuate angles of the first section 121, second section 122, and third section 123. However, the vessel supports 130 may protrude in different orientations, such as normally to any of the respective sections 121, 122, 123. Furthermore, the vessel supports 130 may not be needed to support items to be placed on the drink coaster 100, for example, if items to be placed on the drink coaster 100 are supported by the outer rim 103.

The illustrated vessel supports 130 are generally polygonal in shape, but should not be so limited, and may include, for example, circular or linear shapes. The vessel supports 130 are arranged in a repeating symmetrical pattern radially about the drink coaster 100. The vessel supports 130 are not so limited and may include, for example, asymmetric or non-repeating arrangements. The vessel supports 130 may also be formed from one continuous vessel support (not shown).

Referring to FIG. 7-8, the drink coaster 100 includes a base 150 and an inner wall 160. The base 150 depends inwardly from the bottom section 102*b* of the base wall 102. The base 150 is planar with plane B. The base 150 extends about the drink coaster 100 in a similar manner as does the base wall 102. The base 150 contacts the resting surface 200. In other embodiments, the base 150 may include protective measures such as pads, buffers, soft materials, or the like to further protect the resting surface 200. The inner wall 160 depends perpendicularly upward from the base 150 and extends to the first section 121. However, the inner wall 160 may depend from the base 150 at any angle, for example, arcuately, to provide additional or less structural support for the drink coaster 100.

Referring to FIGS. 3-6, the base 150 includes a plurality of cavities 158*a-d*, 158*f* oriented radially about the base 150 and base wall 102. The cavities 158*a-d*, 158*f* accommodate the outer feet 108*a-d* and head member 108*f* which depend from the base wall 102. However, the base 150 may not include such cavities 158*a-d*, 158*f* but may instead continue about the drink coaster 100 as to connect to the outer feet 108*a-d* and/or head member 108*f*.

Referring to FIG. 7, the drink coaster 100 further includes a plurality of inner feet 152. The inner feet 152 provide additional contact points between the drink coaster 100 and the resting surface 200. The inner feet 152 protrude downwardly from the bottom side 122*b* of the second section 122 at an angle generally perpendicular relative to plane B and extend so far as plane B. The inner feet 152 are oriented radially about the bottom side 122*b* of the second section 122. The inner feet 152 are generally polygonal in shape, but should not be so limited, and may include, for example, circular or linear shapes. Further, the plurality of inner feet 152 may be substituted for one continuous inner foot extending radially about the bottom side 122*b* of the second section 122, or may include only one non-continuous inner foot. Additionally the inner feet 152 are not limited to protruding from the bottom side 122*b* of the second section 122, and may, for example, protrude from the bottom side 121*b* of the first section 121 or the bottom side 123*b* of the third section 123, or any combination thereof. Alternatively, the inner feet 152 may not be needed to provide additional support for the drink coaster 100 in other embodiments.

The central support area 120 is preferably deflectable between the collapsed position (see FIGS. 1-8, 17) and the expanded position (see FIGS. 9-16) by applying upward force to the bottom side 121*b* of the first section 121, bottom side 122*b* of the second section 122, or bottom side 123*b* of the third section 123. The central support area 120, however, may be deflected in any way, for example, by pulling upwardly on the vessel supports 130. After a certain amount of deflection, an internal spring bias (caused by the material from which the drink coaster 100 is formed or the geometry/size/shape of the first section 121, second section 122, or third section 123, for example) moves at least the first section 121 and the second section 122 toward the expanded condition. As the first section 121 and the second section 122 move to the expanded condition, at least the first section 121 and second section 122 preferably assume a generally convex or inverted bowl shape.

The central support area 120 is also preferably deflectable from the expanded position to the collapsed position by applying downward or depressing force to the top side 121*a* of the first section 121, top side 122*a* of the second section 122, or the top side 123*a* of the third section 123. The central support area 120, however, may be deflected in any way, for example, by pushing downwardly on the vessel supports 130. After a certain amount of deflection, the internal spring bias (caused by the material from which the drink coaster 100 is formed or the geometry/size/shape of the first section 121, second section 122, or third section 123, for example) moves at least the first section 121 and the second section 122 toward the collapsed condition. As the first section 121 and the second section 122 move to the collapsed condition, at least the first section 121 and second section 122 preferably assume a generally concave or bowl shape.

In the preferred embodiment, the first section 121 and second section 122 deflect between the collapsed position (see FIGS. 1-8, 17) and the expanded position (see FIGS. 9-16). In the collapsed position, the first section 121 and second section 122 preferably extend downwardly beyond plane T to form a concave or bowl shape. Further, in the collapsed position, the central support area 120 and outer rim 103 are planar with plane T. As described above, in the collapsed position, the first section 121 depends inwardly from the outer rim 103 at a generally concave angle and the second section 122 depends inwardly from the first section 121 at an angle less concave than the angle of the first section 121 relative to the outer rim 103. In the collapsed position, the inner feet 152, outer feet 108*a-d*, hanging member 108*e*, head member 108*f*, support section 125 and base 150 contact the resting surface 200.

In the expanded position, the first section 121, second section 122, third section 123, and support section 125 preferably extend upwardly beyond plane T (see FIGS. 9-16). The drink coaster 100 in the expanded position is not so limited and any one of the first section 121, second section 122, third section 123, and support section 125 may not extend above plane T so long as at least one of the sections thereof extends above plane T. In the expanded position, the central support area 120 and outer rim 103 are no longer planar with plane T, but instead are oriented at an arcuate angle extending upwardly beyond plane T. In other words, in the expanded position, the first section 121 depends inwardly from the outer rim 103 at a convex angle and the second section 122 depends inwardly from the first section 121 at the same convex angle above plane T. However, the second section 122 is not so limited and may, for example, depend at an angle more or less concave than the angle of the first section 121 relative to the outer rim 103. Preferably, the third section 123 incurs no angle change. As such, the third section 123 still depends inwardly at a convex angle from the support section 125. Further, in the expanded position, only the outer feet 108*a-d*, hanging member 108*e*, head member 108*f*, and base 150 contact the resting surface 200. Accordingly, the inner feet 152 and support section 125 do not contact the resting surface 200 in the expanded position. The dimensions of the base 150 and the base wall 102 remain constant while in the collapsed position and expanded position, respectively. The drink coaster 100 is not limited to retaining the same circumferences of the base 150 and base wall 102 when in the collapsed position and expanded position and may include either larger or smaller dimensions caused by switching between the collapsed position and the expanded position.

As a result of the expanded position, the tops of the vessel supports 130 are no longer planar with plane T. In the expanded position, the central support area 120 forms a dome structure. The central support area 120 of the illustrated embodiment forms the same arcuate angle as the outer rim 103 in the expanded position. The central support area 120 extends beyond plane T to a height H (FIGS. 8, 11). However, the central support area 120 is not limited to the same arcuate angle as the outer rim 103 and may form any arcuate angle. Alternatively, the central support area 120 in the expanded position is not restricted to being a dome structure, and may take the form of, for example, a symmetrical or asymmetrical linear structure such as a staircase or zigzag structure.

Although the present invention is illustrated and described above with reference to certain specific embodiments, the present invention is not intended to be limited to the details shown. Various modifications may be made in the details within the scope and range of equivalents of the claims and without departing from the invention. For example, although the drink coaster 100 is illustrated with three sections 121, 122, 123, the drink coaster 100 may have fewer or more sections. In addition, the central support area 120 in the expanded position may be oriented parallel to plane T, providing a similar area to rest items as the central support area 120 in the collapsed position. Moreover, the drink coaster 100 need not assume the Testudine embodiment, but may incorporate other shapes and geometric features, such as circular or polygonal geometries, members of the animal kingdom, or any other decorative representation. The dome shape of the first section 121, second section 122, and third section 123 may have other shapes and/or relative dimensions and still perform the same functions. The support section 125 may be eliminated altogether. The drink coaster 100 may include additional features such as trusses or pilings for support of the items resting on the top surface 110. For example, the drink coaster 100 may include inner feet 152 oriented around the second section 122 or the third section 123.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A multi-positional drink coaster comprising:

a generally planar outer rim defining a periphery of the drink coaster;

a base wall skirting downwardly from the outer rim to a base of the drink coaster, the base being configured to rest atop an underlying surface; and a flexible central support depending laterally inwardly from the outer rim and including opposed upper and lower surfaces, the flexible central support area being manually deflectable between a stationary collapsed position and a stationary expanded position;

wherein, in the collapsed position, the upper surface defines a generally horizontal plane for supporting an object thereon and the lower surface is generally convex, and in the expanded position, the flexible central support area forms an ornamental dome structure with both the upper surface being generally convex and the lower surface being generally concave.

2. The multi-positional drink coaster of claim 1, further comprising at least one foot protruding downwardly from the lower surface and contacting the underlying surface in the collapsed position.

3. The multi-positional drink coaster of claim 1, wherein the flexible central support area includes an internal spring bias for deflecting the flexible central support area between the collapsed and expanded positions, after initial manual deflection thereof.

4. The multi-positional drink coaster of claim 1, wherein the drink coaster is constructed of a single piece of polymeric material.

5. The multi-positional drink coaster of claim 1, further comprising a hanging member protruding outwardly from the base wall and including a through hole for hanging the coaster therefrom.

6. The multi-positional drink coaster of claim 1, wherein the base includes a plurality of cavities, each cavity accommodating a respective foot depending from the base wall for contacting the underlying surface.

7. The multi-positional drink coaster of claim 1, wherein the upper surface includes a plurality of separate support members projecting upwardly to define the generally horizontal plane of the collapsed position.

8. A multi-positional drink coaster comprising:

a generally planar outer rim defining a periphery of a top surface of the coaster;

a base wall skirting downwardly from the outer rim to a base of the drink coaster, the base being configured to rest atop an underlying surface; and a flexible central support area located inward of the outer rim, the central support area including at least a first section depending inwardly from the outer rim, a second section depending inwardly from the first section and a plurality of support members projecting upwardly from the first and second sections, and the central support area being manually deflectable between a collapsed position and an expanded position;

wherein in the collapsed position, the first section depends from the outer rim at a concave angle, the second section depends from the first section at a concave angle and the support members project upwardly to the outer rim, defining a generally horizontal plane for supporting an object thereon, and in the expanded position, the first section depends from the outer rim at a convex angle and the second section depends from the first section at a convex angle, such that central support area and the support members form an ornamental dome structure.

9. The multi-positional drink coaster of claim 8, wherein the second section depends at an angle less concave than the concave angle of the first section depending from the outer rim, in the collapsed position, and the second section depends at approximately an equal convex angle from the first section as the convex angle of the first section from the outer rim, in the expanded position.

10. The multi-positional drink coaster of claim 8, wherein the first and second sections project downwardly from the outer rim and form a concave shape in the collapsed position, and the first and second sections project upwardly from the outer rim and form a convex shape in the expanded position.

11. The multi-positional drink coaster of claim 8, wherein the support members define a plurality of varying lengths.

12. The multi-positional drink coaster of claim 8, wherein the central support area further includes a support section depending inwardly from the second section.

13. The multi-positional drink coaster of claim 12, wherein the support section contacts the underlying surface in the collapsed position.

14. The multi-positional drink coaster of claim 12, wherein the support section is oriented parallel to the generally horizontal plane in the collapsed position.

15. The multi-positional drink coaster of claim 12, wherein the central support area further includes a third section depending inwardly from the support section at a generally convex angle in the collapsed position.

16. The multi-positional drink coaster of claim 15, wherein the central support area and the third section also include support members projecting upwardly therefrom, forming a portion of the generally horizontal plane for supporting an object thereon in the collapsed position and forming a portion of the ornamental dome structure of the central support area in the expanded position.

* * * * *